US008443702B2

(12) United States Patent
Kan et al.

(10) Patent No.: US 8,443,702 B2
(45) Date of Patent: May 21, 2013

(54) TORQUE WRENCH

(75) Inventors: Kyo Kan, Tokyo (JP); Shozo Aikawa, Tokyo (JP); Tomohiro Ogata, Tokyo (JP); Naoya Masuda, Tokyo (JP); Hiroshi Tsuji, Tokyo (JP)

(73) Assignee: Tohnichi Mfg. Co. Ltd., Tokyo (JP)

( * ) Notice: Subject to any disclaimer, the term of this patent is extended or adjusted under 35 U.S.C. 154(b) by 315 days.

(21) Appl. No.: 12/737,539

(22) PCT Filed: Feb. 16, 2010

(86) PCT No.: PCT/JP2010/000922

§ 371 (c)(1),
(2), (4) Date: Mar. 7, 2011

(87) PCT Pub. No.: WO2010/119599

PCT Pub. Date: Oct. 21, 2010

(65) Prior Publication Data

US 2011/0154961 A1 Jun. 30, 2011

(30) Foreign Application Priority Data

Apr. 16, 2009 (JP) ..... 2009-100061
Apr. 16, 2009 (JP) ..... 2009-100062
Jan. 18, 2010 (JP) ..... 2010-007917

(51) Int. Cl.
*B25B 23/14* (2006.01)

(52) U.S. Cl.
USPC ..... 81/467; 81/52; 81/473

(58) Field of Classification Search
USPC ..... 81/52, 467, 473
See application file for complete search history.

(56) References Cited

U.S. PATENT DOCUMENTS 3,236,127 A * 2/1966 Knudsen et al. ..... 81/482
4,653,852 A 3/1987 Suzuki et al.
2007/0107557 A1* 5/2007 Pettit ..... 81/56

FOREIGN PATENT DOCUMENTS

EP DE 35 87 557 6/1995
JP S52-55099 5/1977
JP U S55-60973 4/1980

* cited by examiner

*Primary Examiner* — Lee D Wilson
*Assistant Examiner* — Shantese McDonald
(74) *Attorney, Agent, or Firm* — Manabu Kanesaka

(57) ABSTRACT

To make improvements in torque wrenches with a torque limiter that uses a cam mechanism and to provide a torque wrench that realizes more stable operation and is capable of highly precise tightening. In a torque wrench with a torque limiter that uses a cam mechanism, a solid columnar roller member 14 is engaged with a cam part 7 of a cam shaft 8 such that it is rotatably supported by a roller support lever member 12 mounted in a head portion 2 such as to be rotatable around a support shaft 16 and such that it is pressed against the cam part 7 by a spring force transmitting rod 18 biased by a torque setting spring. The roller support lever member 12 is configured such that the distance r2 from the support shaft 16 to a point of application of force of the spring force transmitting rod 18 is longer than the distance r1 from the support shaft 16 to the roller member 14.

17 Claims, 11 Drawing Sheets

TORQUE WRENCH

RELATED APPLICATIONS

The present application is National Phase of International Application No. PCT/JP2010/000922 filed Feb. 16, 2010, and claims priority from Japanese Applications No. 2009-100061, filed Apr. 16, 2009; No. 2009-100062, filed Apr. 16, 2009; and No. 2010-007917, filed Jan. 18, 2010, the disclosure of which is hereby incorporated by reference herein in its entirety.

TECHNICAL FIELD

The present invention relates to a torque wrench that can tighten a fatener such as a bolt or nut with a specified torque byway of a torque limiter using a cam mechanism that is activated when the specified torque is reached.

BACKGROUND ART

Conventionally, a torque wrench with a torque limiter that uses a cam mechanism is known, which has a configuration in which a cylindrical head portion is attached to a distal end of a cylindrically formed lever. In the head portion, transmission shaft with a square shaft portion, to which an engaging portion such as a hexagonal socket or the like to engage with a fastener such as a bolt or nut is removably attached, is mounted via a ratchet mechanism such that the shaft can rotate only in one direction. When a tightening force is manually applied to the lever and the tightening torque reaches a specified torque, the torque limiter disposed between the head portion and a distal end portion of the lever is activated, so that the fastener is released from the tightening force transmitted thereto (Patent Literature 1).

In the configuration of this torque limiter using a cam mechanism, a cylindrical cam shaft having a plurality of cam parts continuously formed in the circumferential direction on the outer circumferential surface thereof is rotatably disposed inside a cylindrically formed head body, while a cam follower in the form of a columnar roller is pressed against the cam part via a thrust pad mounted to a distal end portion of a torque adjusting spring disposed inside the cylindrical lever. The roller can move in the axial direction of the lever to abut on an inner circumferential surface of the lever. A plurality of ratchet teeth are formed in the circumferential direction on the inner circumferential surface of a shaft hole in the cam shaft, while a main shaft portion of the transmission shaft is rotatably disposed in the shaft hole, so that ratchet claws attached on the outer circumference of the main shaft portion engage with the ratchet teeth. A rotation imparted to the cam shaft in a tightening direction causes the ratchet claws to engage with the ratchet teeth to rotate the transmission shaft, whereby the fastener such as a bolt is tightened.

The cam part of the cam shaft forming the torque limiter is configured such that a torque transmitting cam surface which is a steep slope and a torque non-transmitting cam surface which is a gentle slope are formed on both sides of a cam top. The roller waits in a state where it is pressed against a torque transmitting cam surface of the cam part. A tightening force transmitted via the lever to the roller causes the camshaft to rotate in the tightening direction via the torque transmitting cam surface. As the tightening force to the fastener such as a bolt increases, the reaction force from the torque transmitting cam surface to the roller increases, whereby the roller moves toward the cam top against the spring force of the torque adjusting spring. When the roller goes over the cam top, the roller stops applying the force that rotates the camshaft in the tightening direction, whereby the user is notified that the specified torque has been reached.

PRIOR ART LITERATURE

[Patent Literature]

[Patent Literature 1] Specification of British Patent Application Laid-Open No. 2148767A

SUMMARY OF THE INVENTION

Problems to be Solved by the Invention

In the torque limiter using the conventional cam mechanism described above, the spring force of the torque adjusting spring for determining a specified torque acts directly on the roller. As the spring force of the torque adjusting spring is increased in proportion to the value of the specified torque, during a tightening operation, as the roller receives the reaction force from the torque transmitting cam surface and moves against the spring force of the torque adjusting spring in contact with an inner circumferential wall surface of the lever, it makes high friction contact with the inner wall surface of the lever, and also with the thrust pad. This causes wear on the roller, thrust pad, and inner wall surface of the lever, and there was a worry that this would have adverse effects such as causing the torque limiter to be activated outside a tolerance range of a correct specified torque, or leading to instabilities in the operation.

An object of the present invention is to make a further improvement in torque wrenches having a torque limiter that uses a cam mechanism, and to provide a torque wrench that can realize more stable operation and is capable of highly precise tightening.

Means for Solving the Problems

The torque wrench that achieves the object of the present invention is configured to include: a head portion having a cylindrical cam shaft rotatably disposed with a plurality of cam parts formed on an outer circumference thereof, the cam parts each having a torque transmitting cam surface and a torque non-transmitting cam surface, and a torque transmission shaft coaxially disposed inside the cam shaft for tightening an object to be tightened via a ratchet mechanism; a tubular lever fixed to a rear end portion of the head portion and accommodating therein a spring force transmitting rod biased by a torque setting spring; a roller member engaged with the cam part; and a roller support lever member rotatably mounted in the head portion via a support shaft for rotatably supporting the roller member and for applying the spring force via the spring force transmitting rod to the roller member so as to cause a tightening reaction force to be applied to the roller member, wherein the roller support lever member is configured such that a distance from the support shaft to a point of application of force of the spring force transmitting rod is longer than a distance from the support shaft to the roller member. The roller member may have a solid, columnar structure.

Another configuration of the torque wrench that achieves the object of the present invention includes, in the torque wrench configured as described above, a coupling mechanism for coupling a distal end portion of the lever to a rear portion of the head portion by screw coupling, wherein the coupling mechanism includes threaded portions respectively formed to threaded tube portions respectively formed at the rear end portion of the head portion and at the distal end portion of the lever to be internally or externally screwed to each other, and a cylindrical positioning member abutting on and pressing a distal end portion of one of the threaded tube portions on the internal or external side against the other one of the threaded tube portions, and wherein the positioning member is screwed to the threaded portion of the other threaded tube portion and makes tapered engagement with a distal end portion of the one threaded tube portion so as to fix the head portion and the lever at an arbitrary position in a circumferential direction around an axial center of the lever.

A further configuration of the torque wrench that achieves the object of the present invention includes, in either of the above-described configurations, a sensor that detects an inclining movement of the spring force transmitting rod caused by a rotation of the roller support lever member as the roller member engages with and traces the cam part.

The coupling mechanism positions and fixes the head portion and the lever in a circumferential direction around an axis of the lever, with the position of the sensor and the position of the spring force transmitting rod being set at a predetermined position.

Effects of the Invention

According to the present invention, the spring force of the torque setting spring is applied via the roller support lever member to the roller member engaging with the cam part, with the distance between the support shaft and the point of application of force of the spring force transmitting rod being longer than the distance between the support shaft and the roller member. It is thus possible to make the spring force of the torque setting spring smaller relative to the reaction force applied to the roller member for the torque limiter to be activated, whereby the torque setting spring can be made smaller and lighter, which in turn leads to a reduction in size and weight of other components, and in turn of the entire torque wrench.

According to the invention as set forth in claim 2, the roller member is solid and columnar, whereby the effects of deformation due to the force in the radial direction applied during the tightening can be eliminated. Furthermore, the thickness of the cam part is substantially matched with the axial length of the roller member, and the roller member is supported by the roller support lever member over an entire axial length thereof, so that surface pressure on the roller member is reduced and the roller member can be rotated smoothly.

According to the inventions as set forth in claims 3 and 4, the torque limiter can be activated reliably with an increase in the tightening force.

According to the invention as set forth in claim 5, the cam shaft can be rotated smoothly.

According to the invention as set forth in claim 6, the transmission shaft can be rotated smoothly.

According to the invention as set forth in claim 7, the roller support lever member can be rotated smoothly.

According to the invention as set forth in claim 8, the spring force transmitting rod can be inclined smoothly with an increase in the tightening force.

According to the invention as set forth in claim 9, the activation of the torque limiter can be electrically detected without providing an additional special mechanism.

According to the invention as set forth in claim 10, the head portion and lever can be fixed rigidly and with a simple structure at an arbitrary position in a circumferential direction around the axial center of the lever.

According to the invention as set forth in claim 11, in addition to the effect of the invention according to claim 10 described above, accidental loosening of the positioning member can be prevented as the positioning member is not exposed to the outside of the torque wrench.

According to the invention as set forth in claim 12, tightening of the positioning member can be made easily.

According to the invention as set forth in claim 13, the sensor can be activated without requiring any special mechanism, because of the use of the spring force transmitting rod as means for electrically detecting a specified torque being reached in synchronization with activation of the torque limiter.

According to the inventions as set forth in claims 14 and 15, the head portion and the lever can be positioned and fixed while taking into consideration the sensor and the plane in which the spring force transmitting rod inclines, so that the sensor can output a detection signal indicative of the tightening torque having reached the specified torque at the same time when the torque limiter is activated.

MODES FOR CARRYING OUT THE INVENTION

Figure 1:
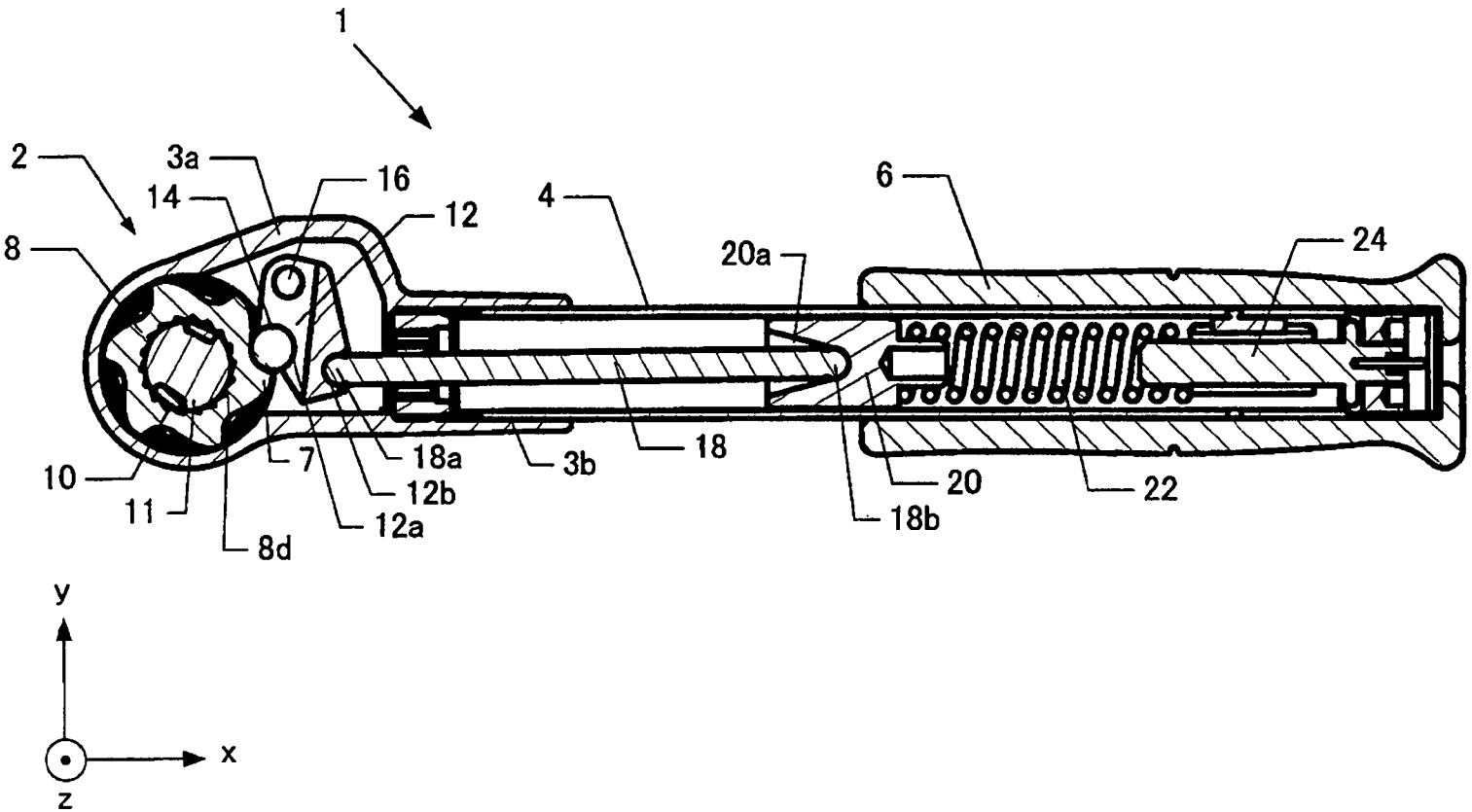
FIG. 1 is a sectional view showing the entire configuration of a torque wrench according to Embodiment 1 of the present invention.

The present invention will be hereinafter described based on embodiments shown in the drawings.

Embodiment 1

Figure 2:
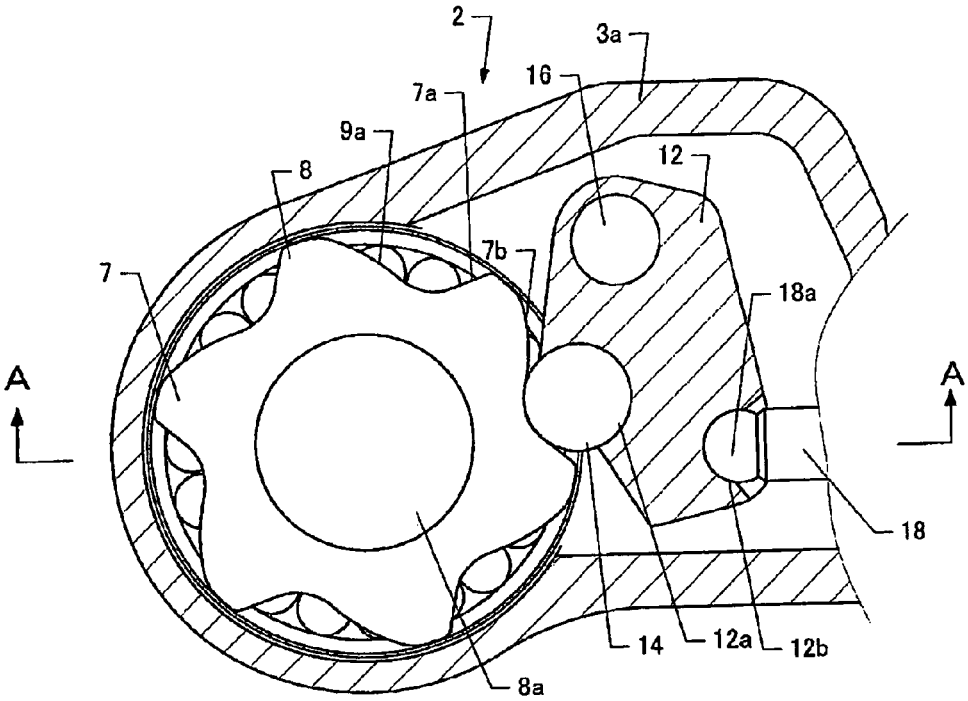
FIG. 2 is an enlarged view of a head portion in FIG. 1.
Figure 3:
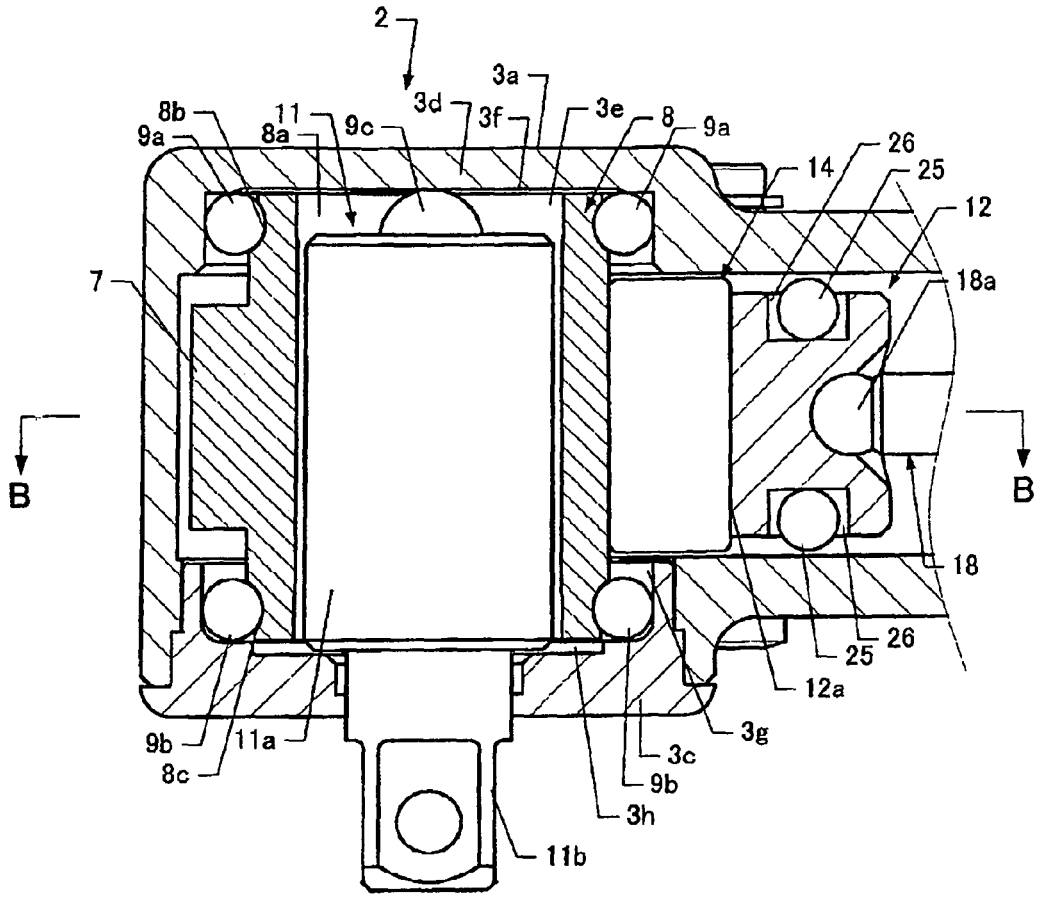
FIG. 3 is a sectional view taken along the line A-A and viewed in the direction of the arrows in FIG. 2.
Figure 4:
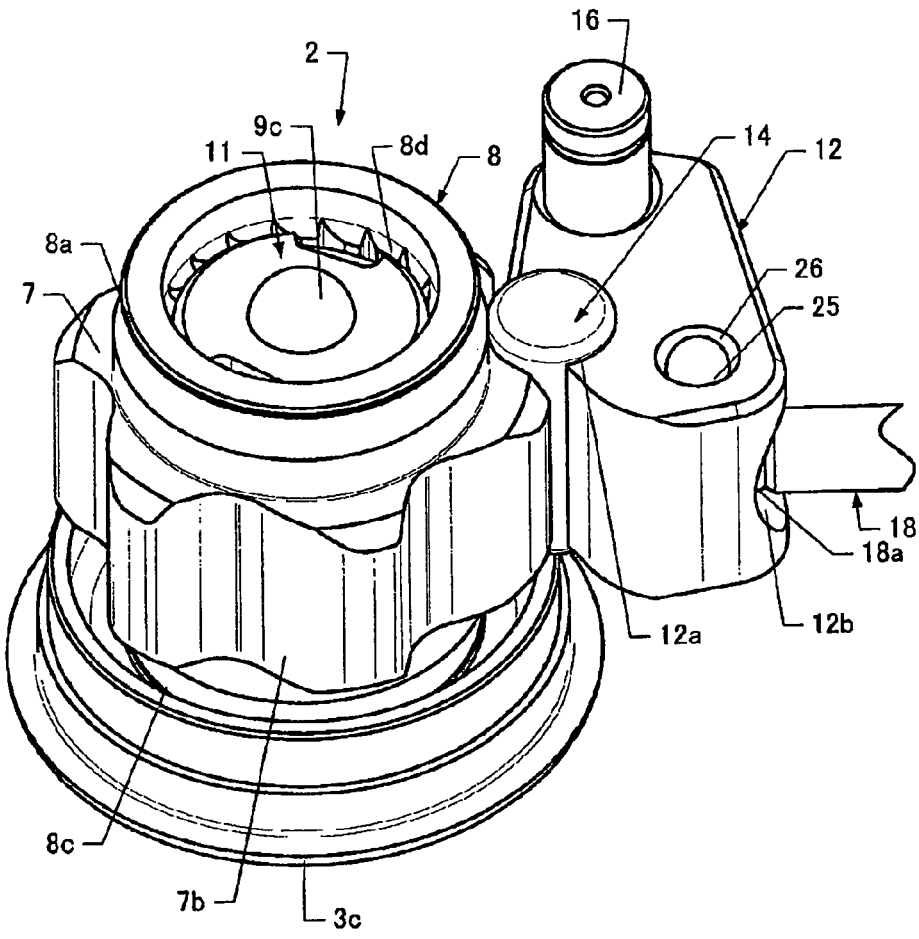
FIG. 4 is an external perspective view of the head portion of FIG. 1 to FIG. 3.

FIG. 1 is a sectional view showing the entire configuration of a torque wrench according to Embodiment 1 of the present invention, FIG. 2 is a view showing a head portion in FIG. 1, FIG. 3 is a sectional view taken along the line A-A and viewed in the direction of the arrows in FIG. 2, and FIG. 4 is an external perspective view of the torque limiter that uses the cam mechanism shown in FIG. 1 to FIG. 3.

The torque wrench 1 of the present embodiment is a torque tool having a mechanical torque limiter that uses a cam mechanism so that a fastener such as a bolt or nut can be tightened with a specified torque.

The torque wrench 1 is composed of a head portion 2 that engages with a fastener (hereinafter described as a bolt by way of example), and a cylindrical lever 4. A grip 6 for a user to hold on during a tightening operation is attached at the rear end of the lever 4. The head portion 2 includes a substantially square parallelepiped case portion 3*a* with a curved surface at the distal end thereof and a threaded tube portion 3*b* formed integrally to the rear end of the case portion 3*a* and having a threaded portion on an inner circumferential surface thereof. Threading a threaded portion formed on the outer circumference at the distal end of the lever 4 into the threaded tube portion 3*b* couples the case portion 3*a* of the head portion 2 and the lever 4, whereby the lever 4 communicates with the case portion 3*a*.

Assuming that the axial direction of the lever 4 is X-axis, the up and down direction of the case portion 3*a* is Z-axis, and the direction orthogonal to both X-axis and Z-axis is Y-axis, the case portion 3*a* of the head portion 2 is open at one end in the Z-axis direction, this end being closed by a lid 3*c*. A cam shaft 8 formed with a shaft hole 8*a* in the center at the distal end thereof is disposed inside the case portion 3*a*.

The cam shaft 8 formed with the shaft hole 8*a* includes an upper circumferential groove 8*b* and a lower circumferential groove 8*c* that are curved recesses formed on the outer circumference at both ends of the shaft portion thereof extending in the Z-axis direction. A plurality of cam parts 7 (six in the present embodiment) are equally spaced along the circumferential direction between the upper and lower circumferential grooves 8*b* and 8*c*. A circular hollow part 3*e* concentric with the cam shaft 8 is formed in an upper wall portion 3*d* of the case portion 3*a*, with a plurality of steel balls 9*a* substantially snugly arranged between an inner circumferential wall surface of the hollow part 3*e* and the upper circumferential groove 8*b* formed at the upper end of the cam shaft 8, thereby forming a radial bearing. The steel balls 9*a* abut also against an upper inner wall surface of the hollow part 3*e* so as to function as a thrust bearing, too. The hollow part 3*e* includes a shallow hollow part 3*f* forming a gap between itself and the upper end of the cam shaft 8.

The lid 3*c* is formed with a circular hollow part 3*g* concentric with the cam shaft 8, with a plurality of steel balls 9*b* substantially snugly arranged between an inner circumferential wall surface of the hollow part 3*g* and the lower circumferential groove 8*c* formed at the lower end of the cam shaft 8, thereby forming a radial bearing. The steel balls 9*b* abut also against a lower inner wall surface of the hollow part 3*g* so as to function as a thrust bearing, too. The hollow part 3*g* includes a shallow hollow part 3*h* forming a gap between itself and the lower end of the cam shaft 8. The diameter of the steel balls 9*a* and 9*b* can be made as close as possible to the depth of the hollow parts 3*e* and 3*g* as shown in FIG. 3, which in turn allows the pressure receiving area of the upper and lower circumferential grooves 8*b* and 8*c* relative to the steel balls 9*a* and 9*b* to be increased. The Hertzian stress, which is a stress applied from the steel balls 9*a* and 9*b*, can be accordingly reduced, whereby wear of the radial bearings can be reduced.

Ratchet teeth 8*d* are formed on the inner circumferential surface of the shaft hole 8*a* of the cam shaft 8 as shown in FIG. 4, with a main shaft 11*a* of a transmission shaft 11 being inserted in the shaft hole 8*a*. A pair of ratchet claws 10 symmetrically arranged to a center axis on the main shaft 11*a* of the transmission shaft 11 is biased by ratchet springs (not shown) to engage with the ratchet teeth 8*d*. When the cam shaft 8 turns in a clockwise direction, the transmission shaft 11 turns integrally therewith. A square shaft 11*b* is formed to the distal end of the transmission shaft 11 such as to extend through the lid 3*c* so that a socket (not shown) or the like can be removably attached thereto. A steel ball 9*c* that forms a thrust bearing is disposed between the end face of the main shaft 11*a* and the hollow part 3*f*.

The plurality of cam parts 7 formed on the outer circumference of the cam shaft 8 are configured such that torque transmitting cam surfaces 7*a* which are steep slopes and torque non-transmitting cam surfaces 7*b* which are gentle slopes are formed on both sides of cam tops.

On the other hand, a substantially square parallelepiped roller support lever member 12 that forms a link mechanism is mounted in a rear part of the case portion 3*a* such as to be pivotable around a support shaft 16 whose axis coincides with the Z-axis direction. The roller support lever member 12 is formed with substantially the same thickness as the thickness in the Z-axis direction of the cam parts 7, with the support shaft 16 being mounted at one end in the lengthwise direction thereof. On one face side of the roller support lever member 12 opposite the cam part 7, a solid columnar roller member 14 which acts as a cam follower is rotatably held in a bearing recess 12*a* formed in a concave shape. This bearing recess 12*a* has an inner radial surface with an inside diameter that is substantially the same as the outside diameter of the roller member 14, so that the roller member 14 abuts on a cam surface of the cam part 7 as it rotates.

The roller support lever member 12 is further formed with a pivot recess 12*b* such as to face the shaft hole of the threaded tube portion 3*b*. This pivot recess 12*b* is formed at a position a longer distance from the support shaft 16 as a starting point than the center position of the roller member 14 in the lengthwise direction of the roller support lever member 12.

Inside the lever 4, a torque setting spring 22 on the rear end side is disposed between a rod seat 20 and an adjusting nut 21. A turning operation from the rear end of the lever 4 of a torque adjusting screw rod 24 threaded in the adjusting nut 21 advances the adjusting nut 21 along the thread forward or backward in the axial direction, thereby adjusting the spring pressure applied to the rod seat 20.

The rod seat 20 is formed with a pivot recess 20*a* facing the pivot recess 12*b* of the roller support lever member 12. A spring force transmitting rod 18 is disposed between the pivot recess 20*a* of the rod seat 20 and the pivot recess 12*b* of the roller support lever member 12. Both ends 18*a* and 18*b* of the spring force transmitting rod 18 are formed spherical (hereinafter "spherical end"), so that they can abut on the pivot recesses 12*b* and 20*a*, following a displacement in Y-axis direction and Z-axis direction, if any, of the positions relative to each other of the pivot recesses 12*b* and 20*a* in the X-axis direction.

In a non-tightened state in which the torque wrench 1 is not tightening a bolt, the roller member 14 is pressed against a base part of a torque transmitting cam surface 7*a* of the cam part 7 by the spring force of the torque setting spring 22 applied from the spring force transmitting rod 18 via the roller support lever member 12. At this position, the roller member 14 is stationary and stably held on the cam part 7. In this stationary state, the spring force transmitting rod 18 is oriented parallel to the X-axis. The roller support lever member 12 is formed with bearing recesses 26 in the upper and lower faces thereof, respectively, in which steel balls 25 fit. These upper and lower steel balls 25 abut on the inner faces of the case portion 3*a* and the lid 3*c* so as to position the roller support lever member 12 in the Z-axis direction, as well as enable smooth rotation of the roller support lever member 12 around the support shaft 16.

From the non-tightened state in which the roller support lever member 12 is held stationary, as the bolt tightening starts, the tightening force applied to the lever 4 is transmitted from the support shaft 16 to the roller support lever member 12, and applied from the roller member 14 to the torque transmitting cam surface 7*a* of the cam part 7. As the bolt is further tightened, the roller support lever member 12 receives a rotating force in the counterclockwise direction around the support shaft 16 due to a reaction force applied from the torque transmitting cam surface 7*a* to the roller member 14. The roller support lever member 12, due to the leverage principle, moves the spring force transmitting rod 18 toward the rear end of the lever 4 against the biasing force of the torque setting spring 22. Namely, the torque limiter starts to act.

As the tightening force to the bolt increases, the reaction force from the torque transmitting cam surface 7*a* to the roller member 14 also increases, whereby the roller member 14 moves toward the cam top against the spring force of the torque setting spring 22. When the roller member 14 goes over the cam top of the cam part 7, the torque limiter is activated whereby the force from the roller member 14 that rotates the cam shaft 8 in a tightening direction no longer acts so that the user knows that a specified torque has been reached.

After the torque limiter is activated wherein the roller member 14 has reached the cam top position, the roller member 14 moves on to abut on the torque non-transmitting cam surface 7*b*, so that the spring force from the torque setting spring 22 is applied via the spring force transmitting rod 18 to the roller support lever member 12 and acts as a rotating force in the clockwise direction, whereby the force required to apply in the tightening direction to the lever 4 is suddenly decreased. The lever 4 then turns idly relative to the bolt until the roller support lever member 12 comes to the above-described stationary state.

Now, the relationships between forces that act on various constituent elements of the torque limiter in the torque wrench of the present embodiment will be described with reference to FIG. 5.

In the non-tightened state of the torque wrench 1, where the roller support lever member 12 is in the above-described stationary state, the reaction force that acts from the torque transmitting cam surface 7*a* to the roller member 14 is denoted by P1. This reaction force P1 is a force in a normal direction at a position where the torque transmitting cam surface 7*a* and the roller member 14 abut each other. In the present embodiment, the vector direction of this reaction force P1 is displaced by an angle θ toward a bolt tightening direction from the direction of a base line that is a line connecting the center of the support shaft 16 and the axial center of the roller member 14.

Accordingly, when a tightening force is applied during tightening of a bolt from the roller member 14 to the torque transmitting cam surface 7*a* of the cam part 7, a reaction force P2 toward the cam top side along a tangent line between the roller member 14 and the torque transmitting cam surface 7*a* acts on the roller member 14, i.e., a force acts such as to push out the roller member 14 toward the cam top side. Here, the reaction forces P1 and P2 satisfy the following relationship:

$$P2=P1\times\tan\theta \quad (1).$$

As is seen from the above equation (1), the smaller the angle θ is between the normal line and base line at the position where the torque transmitting cam surface 7*a* and the roller member 14 abut each other, the smaller the force P2 is relative to the force P1. This force P2 that pushes out the roller member 14 pushes the roller support lever member 12 toward the rear of the torque wrench 1, and this force acts on the spring force transmitting rod 18 via the pivot recess 12*b*.

On the other hand, the force F that acts from the roller support lever member 12 to the spring force transmitting rod 18 can be made even smaller than the force P2 required for the torque transmitting cam surface 7*a* to push out the roller member 14.

This is because the interaxial distance r2 between the axial center of the support shaft 16 and the center of one spherical end 18*a* of the spring force transmitting rod 18 is longer than the interaxial distance r1 between the axial centers of the support shaft 16 and roller member 14. Namely, since the moment (torque) around the support shaft 16 is determined by a product of a distance from the support shaft 16 to a point of application of force and a force applied, the moment (torque) around the support shaft 16 at the roller member 14 is equal to the moment (torque) around the support shaft 16 at one spherical end 18*a* of the spring force transmitting rod 18. Therefore, the force F acting at the position of the longer distance r2 than the distance r1 from the support shaft 16 is smaller than P2.

The force F acting on the spring force transmitting rod 18 being smaller than the force P1 means that the force that pushes back the spring 22 is smaller than P1. This in turn means that the force the torque setting spring 22 requires to press the roller support lever member 12 in order to press the roller 14 against the cam 8 is smaller than P1.

For this reason, the torque wrench 1 of the present embodiment can employ a smaller, lighter spring with a lower spring constant in contrast to conventional ones for the torque setting spring 22. Also, since the force acting from the roller support lever member 12 to the spring force transmitting rod 18 and the force acting from the spring force transmitting rod 18 to the rod seat 20 are smaller than P1, smaller and lighter components can be used for the spring force transmitting rod 18 and the rod seat 20, too. Accordingly, the torque wrench 1 of the present embodiment provides the effect of enabling reduction in size and weight of the entire torque wrench 1.

As described above, the forces P2 and F can be varied by changing the angle θ between the direction of the force P1 (normal direction) and the direction of the base line at the position where the torque transmitting cam surface 7*a* of the cam part 7 and the roller member 14 abut each other. The angle θ is preferably larger than 0° and smaller than 45°.

If the angle θ is 0°, the force P1 in the normal direction coincides with the direction of the link, whereby the roller 14 is merely pushed toward the support shaft 16, and no component of force that pushes back the roller 14 against the force of the spring 22 acts on the roller 14. Therefore, the angle should preferably be not 0° since the torque wrench could then not function as a torque wrench.

Figure 5:
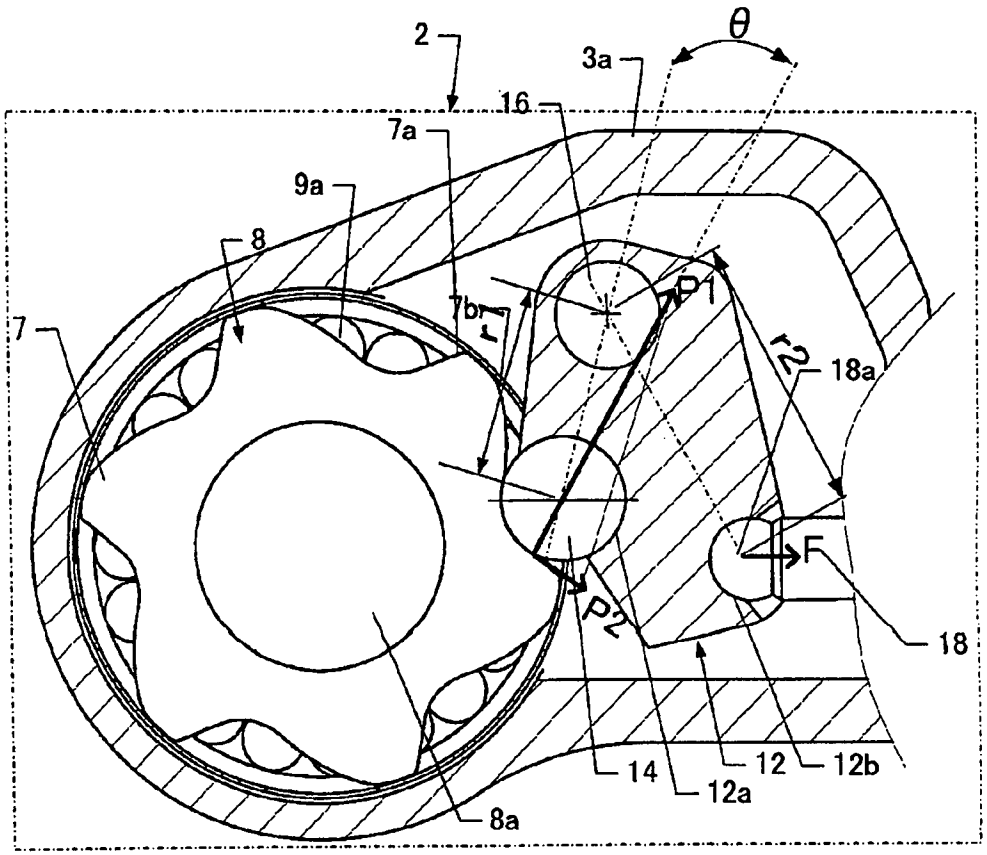
FIG. 5 is a diagram along the line B-B and viewed in the direction of the arrows in FIG. 3, showing vectors of the tightening force acting on the torque limiter of FIG. 4.

If the angle is smaller than 0°, in other words, if the direction of the force P1 is on the counterclockwise side of the base line connecting the support shaft 16 and the roller member 14 in FIG. 5, the force that acts on the roller member 14 acts in an opposite direction from the direction in which it pushes back the roller member 14 against the spring force of the torque setting spring 22. Therefore, this is not preferable either since, in this case, the torque wrench 1 could not function as a torque wrench.

If the angle θ is larger than 45°, the force P1 in the normal direction becomes equal to the force P2, which lessens the effect of reducing the force required to apply to the torque setting spring 22 by the function of the roller support lever member 12, and thus is not preferable.

The angle θ between the direction of the base line and the direction of the force P1 (normal direction) may be adjusted by changing the positional relationship between the support shaft 16 and the roller member 14 thereby to vary the length in the base line direction, or by changing the curved surface shape of the torque transmitting cam surface 7*a* of the cam-part 7. For example, disposing the support shaft 16 at a position further toward the distal end of the head portion 2 than the position illustrated in FIG. 5 increases θ, which in turn increases P2. The angle θ can also be made smaller by increasing the inclination of the slope of the torque transmitting cam surface 7*a* abutting on the roller member 14 in the non-tightened state, as the normal line direction is thereby made closer to the base line direction. Conversely, decreasing the above-mentioned inclination increases θ.

In the torque wrench 1 of the present embodiment, similarly, the force that acts on the torque setting spring 22 can be varied by changing the distance r2 between the support shaft 16 and the pivot recess 12*b* (i.e., the point of engagement of one spherical end 18*a* of the rod 18). For example, setting the pivot recess 12*b* at a position farther away from the support shaft 16 so that the interaxial distance r2 is longer than that illustrated in FIG. 5 makes F smaller, since, as described above, the moment around the support shaft 16 is the same. Note, however, increasing the interaxial distance r2 too much obviously leads to an increase in size of the roller support lever member 12 and, in turn, of the head portion 2.

Increasing the interaxial distance r2 also leads to a larger displacement (in the Y-axis direction) between the position of the pivot recess 12*b* and the position of the pivot recess 20*a* of the rod seat 20 in the non-tightened state. This in turn results in a larger inclination of the spring force transmitting rod 18 relative to the X-axis direction of the torque wrench 1 in the non-tightened state. Applying a force to the rod 18 in this state causes a larger component of force in the Y-axis direction of the force to act on the rod seat 20. This component of force in the Y-axis direction presses the rod seat 20 against the inner surface of the lever 4 and increases friction, which may cause a decrease in torque measurement precision and is not preferable.

As described above, according to the torque wrench 1 of the present embodiment, the torque limiter is configured such that, the solid columnar roller member 14 abutting on the cam part 7 of the cam shaft 8 is rotatably disposed in the bearing recess 12*a* of the roller support lever member 12, and such that the force acting against the force of the torque setting spring 22 can be made smaller than the force along the normal direction acting from the torque transmitting cam surface 7*a* to the roller member 14. This enables reduction in size and weight of the components such as the torque setting spring 22 and the spring force transmitting rod 18 that couples the roller support lever member 12 with the torque setting spring 22. Accordingly, a small, light-weight torque wrench can be provided.

In a torque wrench with a torque limiter configured using a conventional cam mechanism disclosed in the specification of British Patent Application Laid-Open No. 2148767A, in which a cam follower roller or the like is pressed against a cam directly with a spring, there is a friction between the roller and the inner surface of the head or lever as the rotating roller slides along a torque transmitting cam surface of the cam. In contrast, according to the torque wrench 1 of the present embodiment, the roller member 14 is supported by the roller support lever member 12 which is pivotable around the support shaft 16, so that there is no friction between the roller member 14 and the inner surface of the head portion 2 or the lever 4. Accordingly, a torque wrench wherein friction during the operation is reduced as compared to the above-mentioned conventional torque wrench can be provided.

In the present embodiment, the spring force transmitting rod 18 has been described to have an engagement structure using a spherical surface and a recess that enable a pivoting action between the spring force transmitting rod 18 and the roller support lever member 12 and the rod seat 20. The present invention is not limited thereto. As described above, in the torque wrench 1 of the present embodiment, the tracing action of the roller member 14 along the cam surface of the cam part 7 takes place within the X-Y plane shown in FIG. 5. Therefore, shafts may be extended at both ends of the spring force transmitting rod 18 so that they engage with the roller support lever member 12 and the rod seat 20 such as to be pivotally supported, or, a disk-like engagement portion may be configured that slides only in a circumferential direction within the X-Y plane.

Embodiment 2

Figure 6:
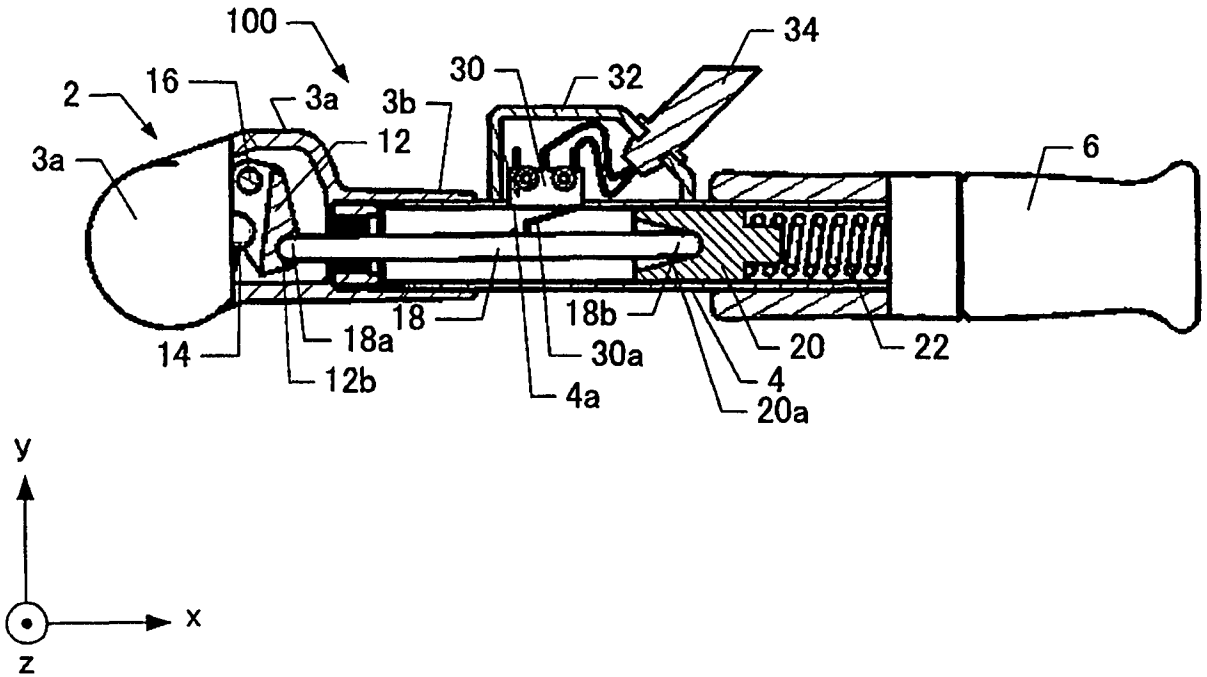
FIG. 6 is a partial sectional view of a torque wrench according to Embodiment 2, showing a state where the switch is not activated.
Figure 7:
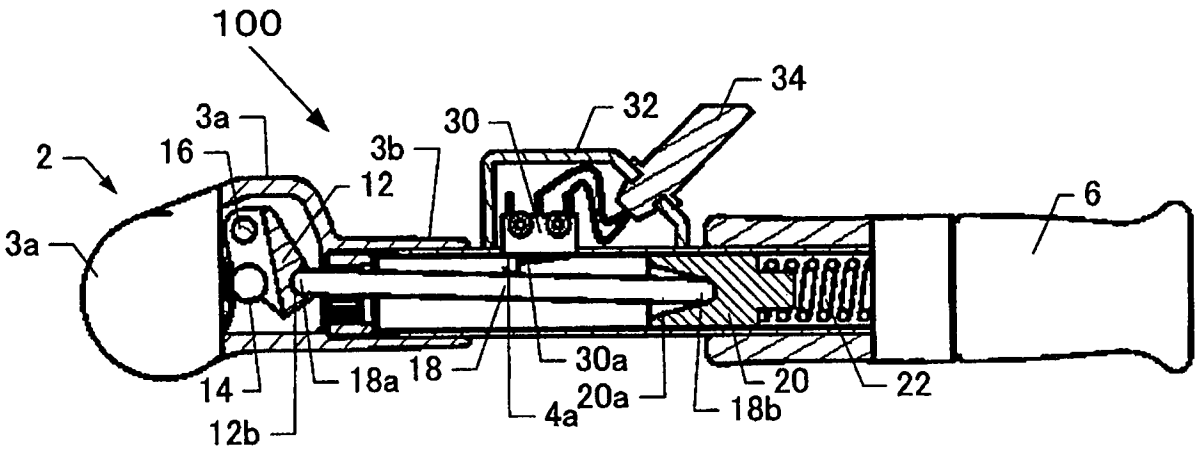
FIG. 7 is a partial sectional view of a torque wrench according to Embodiment 2, showing a state where the switch is activated.

FIG. 6 and FIG. 7 are plan views showing the internal structure of a torque wrench 100 according to Embodiment 2 of the present invention by a partial cross section. The elements identical to those shown in FIG. 1 to FIG. 5 are given the same reference numerals and will not be described again.

The torque wrench 100 of the present embodiment includes a torque limiter shown in Embodiment 1, and a function for electrically detecting the tightening torque of the bolt having reached a specified torque based on the activation of the torque limiter, utilizing the fact that the spring force transmitting rod 18 held between the opposing pivot recesses 12*b* and 20*a* changes its orientation from being parallel to inclined relative to the X-axis direction because of a rotation of the roller support lever member 12 upon the start of activation of the torque limiter during tightening of the bolt.

According to the torque wrench 100 of the present embodiment, during a tightening operation using a torque wrench of the type shown in Embodiment 1, the completion of tightening with a specified torque can be detected by an electrical signal. Therefore, using this signal, for example, the user may be notified of the completion of tightening with a sound, light, or the like, or, the number of tightening may be counted by outputting the signal indicative of the completion of tightening to an external information processing device. Accordingly, with the torque wrench 100 of the present embodiment, the tightening operation can be managed, for example, by checking whether there has been any bolt left untightened, or the like.

The torque wrench 100 of the present embodiment includes a sensor 30 disposed on the outer circumference of the cylindrically formed lever 4 for detecting the spring force transmitting rod 18 having reached a predetermined inclination angle. A microswitch having a mechanical switching configuration is used for the sensor 30. An opening 4*a* is formed to a portion of the circumferential wall of the lever 4 corresponding to the sensor (hereinafter described as a microswitch) 30, with a switch operating lever 30*a* of the microswitch 30 making contact with an outer circumferential surface of the spring force transmitting rod 18 inside the lever 4 through this opening 4*a*.

When the tightening of the bolt starts, the spring force transmitting rod 18 starts to incline from the non-tightened state shown in FIG. 6 where it is parallel to the X-axis. As the inclination of the spring force transmitting rod 18 is increased, the switch operating lever 30*a* is inclined toward a direction in which it pushes in a switch element (not shown). When the spring force transmitting rod 18 reaches a maximum inclination angle at which the torque limiter is activated, as shown in FIG. 7, the microswitch 30 is switched from OFF state to ON state, thereby outputting a detection signal to an external device through a cord 34 connected to the sensor 30. The microswitch 30 is accommodated inside an outer case 32, which protects the microswitch 30 as well as prevents dust or dirt from entering into the lever 4 through the opening 4*a*. By this ON signal thus output, the completion of one tightening operation with a specified torque can be detected.

As described above, according to the torque wrench 100 of the present embodiment, a tightening completion signal indicative of the completion of tightening of a fastener such as a bolt with a specified torque can be output to an external device. Accordingly, the number of tightened bolts can be counted to check if there is any bolt left untightened.

While a limit switch is used for the sensor 30 in the torque wrench 100 of the present embodiment, the invention is not limited to this. Any type of sensor or switch that can detect a change in the inclination of the rod 18 can be used, such as sensors using magnetism, laser, ultrasonic sound, or the like.

While the sensor 30 was described as being disposed on a lateral surface on one side of the Y-axis direction of the lever 4 in the present embodiment, the invention is not limited to this. It may be disposed at any position as long as it can determine a change in the inclination of the rod 18.

Embodiment 3

Figure 8:
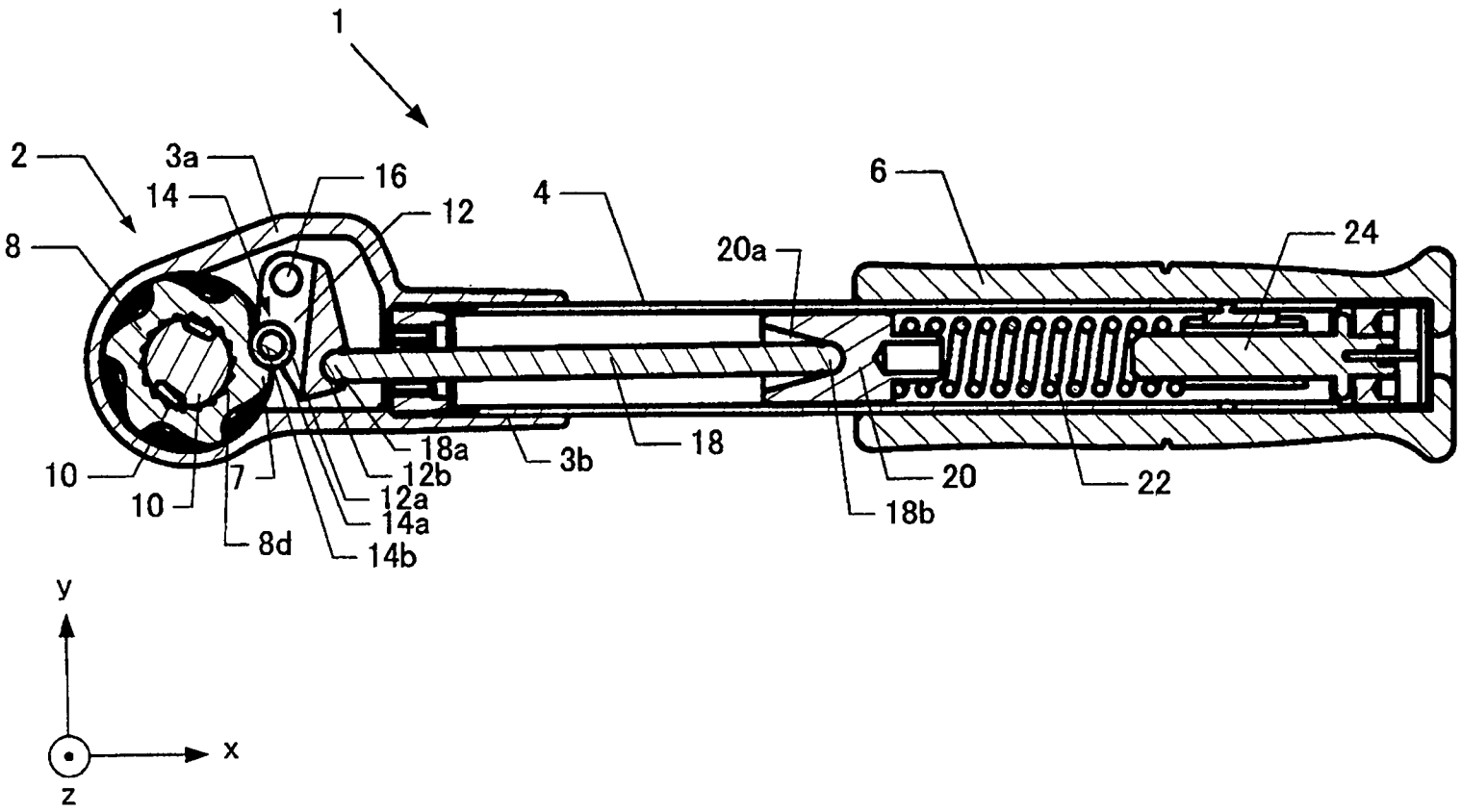
FIG. 8 is a sectional view showing the entire configuration of a torque wrench according to Embodiment 3.

FIG. 8 is a sectional view showing the entire configuration of a torque wrench according to Embodiment 3. The elements identical to those of the reference numerals described above and shown in FIG. 1 are given the same reference numerals in FIG. 8 and will not be described again.

While the roller 14 is solid and columnar in Embodiment 1 shown in FIG. 1, in the embodiment shown in FIG. 8, the roller 14 is formed by a hollow cylindrical roller body 14*a* and a roller shaft 14*b* supported at both ends by the roller support lever member 12, such that the roller shaft 14*b* rotatably extends through the roller body 14*a*.

In FIG. 8, similarly to Embodiment 1 shown in FIG. 3, a large number of steel balls 9*a* and 9*b* are disposed between the outer circumferential surface of the cam shaft 8 and the inner circumferential surface of the head portion 2, respectively, to form radial bearings at upper and lower parts of the cam shaft 8. Instead, the cam shaft 8 may be supported relative to the head portion 2 by a rolling bearing having a ring-like inner race, a ring-like outer race, and a plurality of rolling elements such as steel balls or rollers disposed between the inner and outer races. In this case, the inner races are respectively mounted to the upper and lower parts of the cam shaft 8, whereas the outer races are attached to the inner circumferential surface of the head portion 2. This rolling bearing may be applied to Embodiment 1 described above, too.

Embodiment 4

Figure 9:
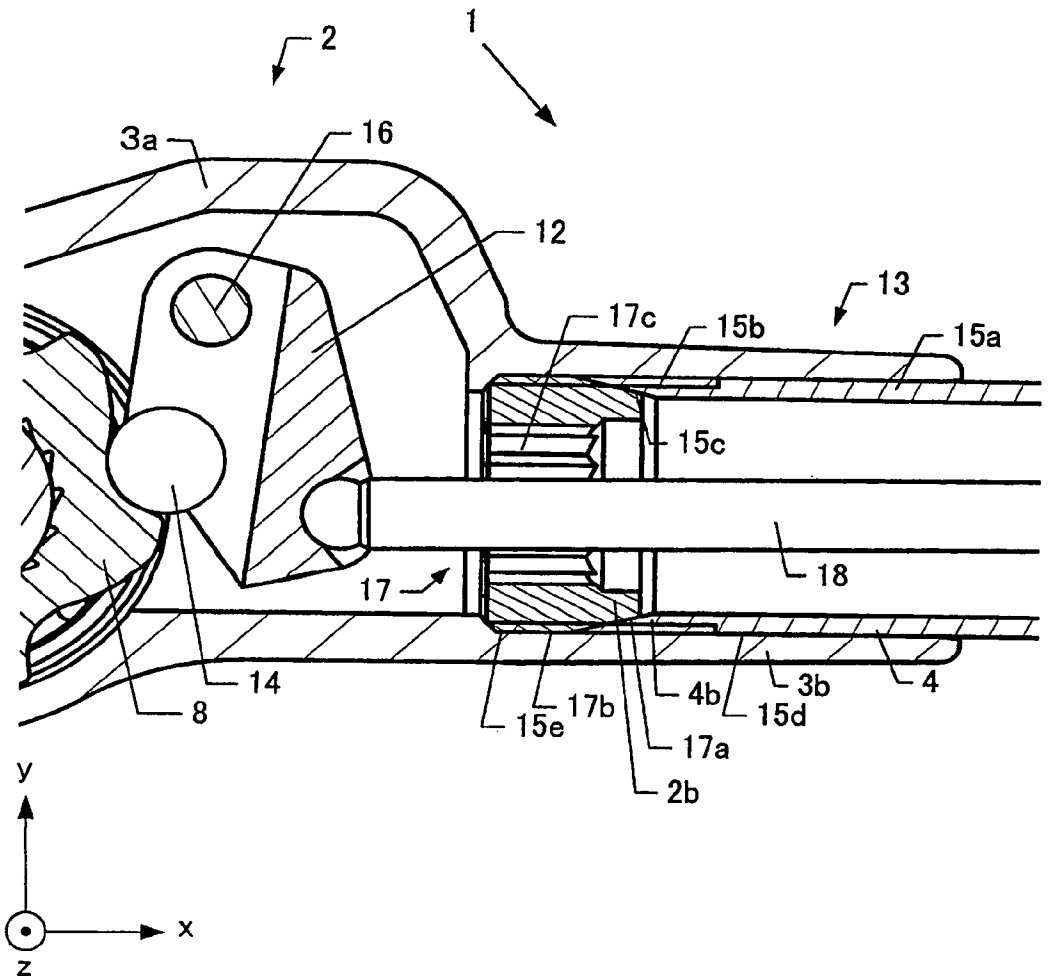
FIG. 9 is a partially cut-away sectional view showing the detail of a coupling mechanism coupling the head and the lever of a torque wrench according to Embodiment 4.

FIG. 9 is a partially cut-away sectional view showing the detail of a coupling mechanism for coupling the head and the lever of a torque wrench according to Embodiment 4 of the present invention.

In the embodiment shown in FIG. 6 and FIG. 7, the inclining movement of the spring force transmitting rod 18 is used to turn on the microswitch 30 so as to enable electrical detection of the activation of the torque limiter. In this case, the lever 4 to which the microswitch 30 is secured and the head 2 need to be coupled together at a predetermined position in the circumferential direction around the center axis line of the lever 4 as the center, so that the spring force transmitting rod 18 can be inclined to a position where it turns on the microswitch 30 at the exact moment when the torque limiter is activated.

In FIG. 9, the distal end of the cylindrically formed lever 4 is formed by a threaded tube portion 15*a* formed with a male threaded portion on the outer circumferential surface, and a thin, cylindrical, tubular spreading portion 15*b* continuously formed to the front of the threaded tube portion 15*a*. The tubular spreading portion 15*b* is formed thin to have a smaller diameter than the outside diameter of the threaded tube portion 15*a*, and its distal end inner circumferential surface (referred to as "tapered female engaging portion") 15*c* is formed in a horn-shape, with the inner diameter gradually increasing toward the distal end.

The inner circumferential surface of the threaded tube portion 3*b* of the head 2 is formed with a first female threaded portion 15*d* into which the threaded tube portion 15*a* of the lever 4 is screwed, and a second female threaded portion 15*e* located more forward than the first female threaded portion 15*d*. A cylindrical positioning member 17 is screwed into this second female threaded portion 15*e*.

The positioning member 17 is composed of a threaded portion 17*b* formed on the outer circumference to be screwed into the second female threaded portion 15*d*, a tapered pressing portion (tapered male engaging portion) 17*a* formed at the rear of the threaded portion 17*b* to abut and make, tapered engagement with the tapered female engaging portion 15*c*, and an engaging hole (hexagonal hole) 17*c* formed in a center hole portion to engage with, for example, a hexagonal wrench (not shown). The spring force transmitting rod 18 extends through this hexagonal hole 17*c*. The pressing portion 17*a* is formed to have a tapered surface with the outside diameter gradually decreasing from the distal end side toward the rear end side.

Before screwing the threaded tube portion 15*a* of the lever 4 into the first female threaded portion 15*d* of the threaded tube portion 3*b* of the head 2, the positioning member 17 is first screwed into the second female threaded portion 15*e*. The first and second female threaded portions 15*d* and 15*e* may be formed as one female threaded portion.

The position at which the spring force transmitting rod 18 extends through the engaging hole 17*c* varies because the position of the pivot recess 12*a* changes in accordance with the action of the roller support lever member 12, as described above. Therefore, the engaging hole 17*c* is designed to have such an inside diameter that the spring force transmitting rod 18 does not contact it even though its position changes in accordance with the action of the roller support lever member 12.

The structure of the coupling mechanism 13 of the present embodiment is as described above. Below, the method of positioning and fixing the head 2 and the lever 4 in their circumferential direction will be described.

With a torque wrench of the type that screw-couple the cylindrical head 2 and the lever 4 as the torque wrench 1, a firm coupling can be achieved relative to the operation of tightening a fastener. Nevertheless, depending on how the screw is threaded or how the head 2 and the lever 4 are tightened, there are variations in relative positional relationship between them in the circumferential direction when they are screw-coupled. The torque wrench 1 of the present embodiment, by means of the positioning member 17, can precisely determine their coupling position in the circumferential direction. More specifically, as shown in FIG. 6, they are positioned such that the opening 4*a* for the microswitch 30 coincides with the Y-axis.

The coupling method involves, first, screwing the positioning member 17 into the second female threaded portion 15*e* inside the threaded tube portion 3*b* of the head 2 as described above to the farthest end in the direction of the distal end of the head 2. The threaded tube portion 15*a* of the lever 4 and the first female threaded portion 15*d* of the threaded tube portion 3*b* of the head 2 are screwed and coupled to each other. As the lever 4 is screwed into the head 2, the tapered female engaging portion 15*c* formed at the distal end of the lever 4 abuts and makes tapered engagement with the pressing portion 17*a* of the positioning member 17. The spreading portion 15*b* of the lever 4 is then gradually and elastically pushed open as mentioned above by the wedge effect so that it is pressed against the inner circumferential surface of the threaded tube portion 3*b* of the head 2, whereby the head 2 and the lever 4 are tightened to each other. After being tightened to some degree, the head 2 and the lever 4 are adjusted to a desired position in the circumferential direction in which they are tightened.

Next, a hexagonal wrench is inserted from the opening in the case portion 3*a* provided for mounting the cam 8, transmission shaft 11, and the like, so as to turn the positioning member 17 to advance along the thread toward the lever 4. This causes the pressing portion 17*a* of the positioning member 17 abutting on the tapered female engaging portion 15*c* of the spreading portion 15*b* of the lever 4 to further push open the spreading portion 15*b*. In this way, the distal end 4*b* of the lever 4 is pressed against the coupling portion 2*b* of the head 2, whereby the head 2 and the lever 4 are rigidly coupled together. The torque wrench 1 can be eventually assembled by mounting components such as the cam part 7 into the case portion 3*a* after the positioning and fixing made in this way.

The head 2 and the lever 4 are thus tightened and coupled together to such an extent that a sufficient strength can be secured for the tightening operation, and further, with their positions in the circumferential direction in which they are screw-tightened relative to each other being adjusted to a desired position, the positioning member 17 is advanced along the thread toward the lever 4 so that they are further rigidly tightened and fixed together. Thereby, the head 2 and the lever 4 are rigidly coupled together with their positions precisely set at a predetermined position in the circumferential direction.

The positioning member 17 of the present embodiment is screwed inside the head 2, as described above, so that it cannot be manipulated easily after the torque wrench 1 is assembled. Therefore, there is no accidental displacement thereof and consequent misalignment in the coupling position during use of the torque wrench 1.

As described in Embodiment 2, the start of the tightening of the torque wrench 1 initiates activation of the torque limiter, turning the roller support lever member 12 around the support shaft 16, and when the torque limiter changes its orientation from the non-activated state shown in FIG. 6 to the activated state shown in FIG. 7, the spring force transmitting rod 18 changes its inclination relative to the X-axis direction.

In the present embodiment, the head 2 and the lever 4 are positioned and fixed to each other by the coupling mechanism 13 such that the spring force transmitting rod 18 and the switch operating lever 30*a* of the microswitch 30 both move parallel to the X-Y plane.

Namely, in the non-activated state shown in FIG. 6 before the specified torque is reached, the microswitch 30 is OFF, while, in the torque limiter-activated state shown in FIG. 7, the rod 18 is inclined maximum in the X-Y plane, whereby the switch operating lever 30*a* is pushed to turn on the microswitch 30. After that, the roller member 14 moves on to the position of the next cam part 7 thereby rendering the torque limiter non-activated and turning off the microswitch 30. With the ON signal thus output, the completion of one tightening operation with a specified torque can be detected. Here, the switch operating lever 3*a* is moved by the inclining movement of the spring force transmitting rod 18 at the same time when the torque limiter is activated, so that the ON signal can be output precisely.

Without the coupling mechanism 13, the positional relationship between the head 2 and the lever 4 in the coupled state can still be determined to some extent by determining the length of the threaded portions and the threading starting position for the screw coupling. There are, however, variations depending on how they are tightened or on the forming precision of the thread grooves.

As described above, according to the present embodiment, in the case where a microswitch 30 is mounted to the lever 4 for detecting the change in inclination of the spring force transmitting rod 18 in order to detect the completion of tightening, the head 2 and the lever 4 can be precisely positioned to each other in the circumferential direction, and the completion of tightening with a specified torque can be reliably detected in accordance with the activation of the torque limiter. Accordingly, the number of tightened bolts can be precisely counted to check if there is any bolt left untightened, or the like.

The torque wrench having the cam shaft 8, the roller support lever member 12, the roller member 14, and the spring force transmitting rod 18 was described as one example in the present embodiment as a torque wrench 1 having the head 2 and the lever 4 coupled together by screw threading, but the invention is not limited to this. The positioning member according to the present invention can be applied to any type of torque wrench, as long as it is a torque wrench of the type having a head and a lever screw-coupled to each other, wherein their relative positional relationship in the circumferential direction needs to be determined. The positioning member is not to be limited by the mechanism itself for tightening with a predetermined torque.

Also, while a torque wrench of the type that has the head 2 and the lever 4 tightened together by screw engagement between an inner circumferential surface of the head 2 and an outer circumferential surface of the lever 4 was described in the present embodiment, the invention is not limited to this. For example,thread grooves may be formed in the outer circumferential surface of the head and in the inner circumferential surface of the lever to screw-couple them together. In this case, the positioning member 17 is screwed into the inner circumferential surface of the lever 4 such that the tapered portion 3*a* is directed toward the head 2. After screw-coupling the lever 4 with the head 2 and positioning them at a predetermined position, the positioning member 17 is advanced along the thread toward the head 2. This pushes the head 2 open relative to the lever 4, so that they can be rigidly fixed together in their position-adjusted state.

Embodiment 5

Figure 10:
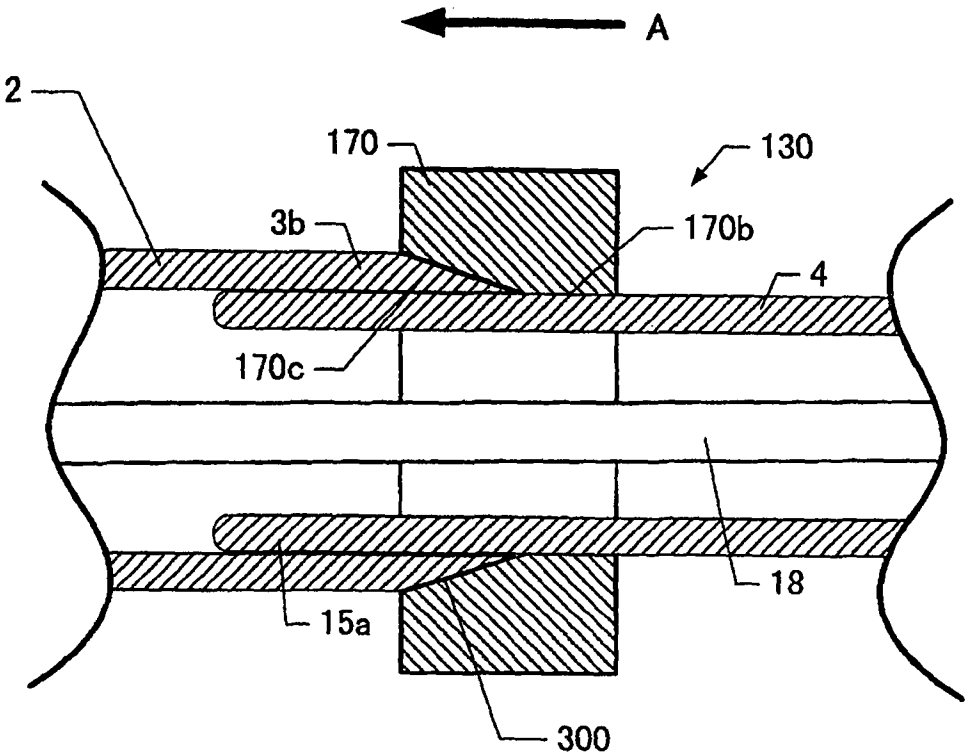
FIG. 10 is a partially cut-away sectional view showing the detail of a coupling mechanism coupling the head and the lever of a torque wrench according to Embodiment 5.

FIG. 10 is a partial sectional view showing the detail of another coupling mechanism for coupling the head and the lever of a torque wrench according to Embodiment 5 of the present invention.

The coupling mechanism 130 of the present embodiment is configured such that, the threaded tube portion 15*a* provided at the distal end of the lever 4 is screwed into a female threaded portion formed on the inner circumferential surface of the threaded tube portion 3*b* of the head 2, and a nut-like positioning member 170 screwed on the outer circumference of the threaded tube portion 15*a* of the lever 4 is advanced along the thread forward as indicated by arrow A so as to position and fix the lever 4 and the head 2 in a circumferential direction around the X-axis.

The threaded tub portion 3*b* of the head 2 is formed at the rear end thereof with a tightened portion (tapered male engaging portion) formed as a tapered surface, this tightened portion 300 being formed as a tapered surface with its outside diameter gradually decreasing toward the rear. The nut-like positioning member 170 is formed with a tightening portion (tapered female engaging portion) 170*c* having a horn-like inner circumferential surface to the front of the female threaded portion 170*b* screwed onto the threaded tube portion 15*a*, the tightened portion 300 forming a tapered surface abutting and making tapered engagement therewith.

The positioning and fixing by the coupling mechanism 130 of the present embodiment is achieved by first screwing the positioning member 170 onto the outer circumferential surface of the lever 4 and then by screw-coupling the lever 4 with the head 2. After positioning the head 2 and the lever 4 at a predetermined position in the circumferential direction, the positioning member 170 is advanced along the thread toward the head 2 (in the direction of arrow A). This causes the tightening portion 170*c* to press the tightened portion 300 of the head 2 against the outer circumferential surface of the threaded tube portion 15*a* of the lever 4, whereby the head 2 and the lever 4 are rigidly coupled together.

In the case with using this positioning member 170, the coupling portion between the head 2 and the lever 4 may have a configuration wherein they are coupled together with the outer circumferential surface of the head 2 being screwed to the inner circumferential surface of the lever 4. In this case, the positioning member 170 may be advanced along the thread from the head 2 side toward the lever 4 to press the lever 4 against the head 2, whereby they can be rigidly positioned and fixed.

Embodiment 6

Figure 11:
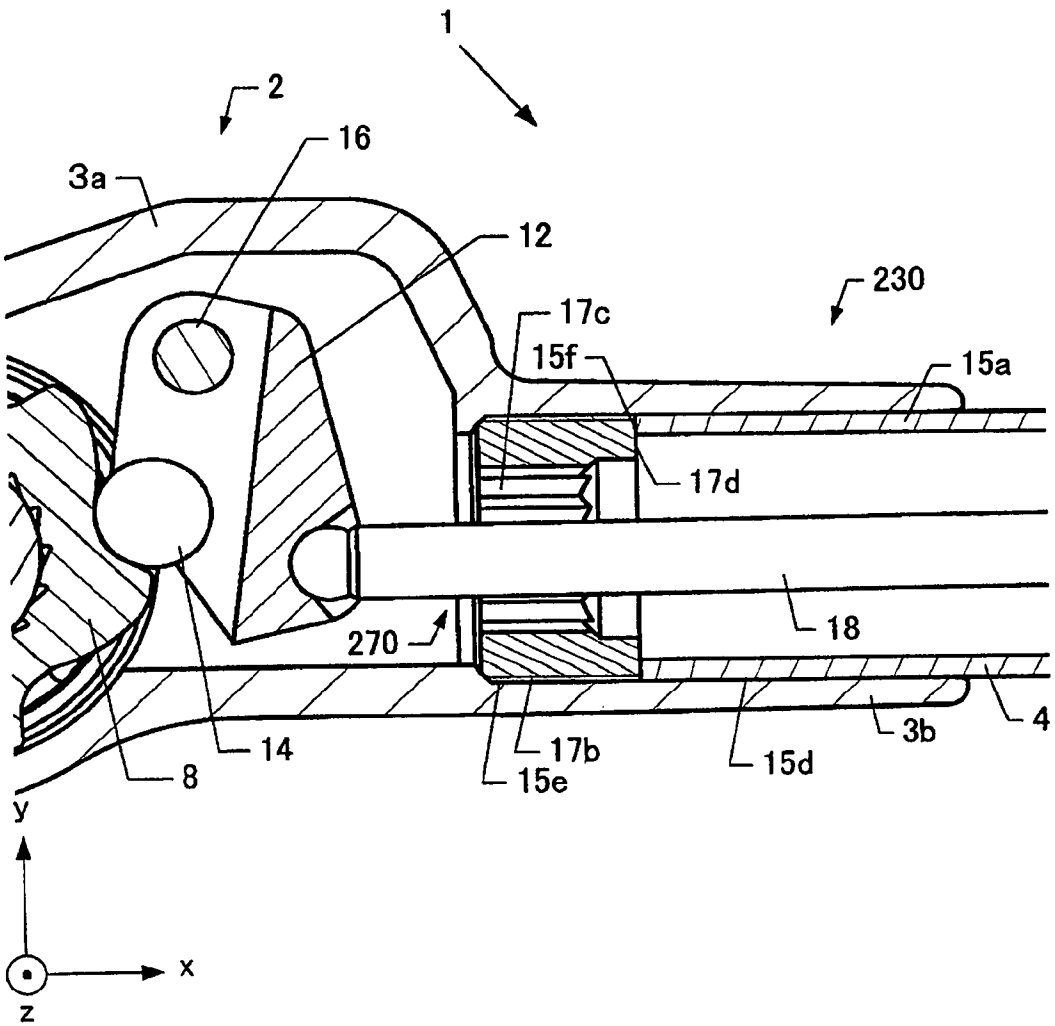
FIG. 11 is a partially cut-away sectional view showing the detail of a coupling mechanism coupling the head and the lever of a torque wrench according to Embodiment 6.

FIG. 11 shows Embodiment 6 of the present invention. The elements identical to those shown in FIG. 8 are given the same reference numerals and will not be described again.

In the coupling mechanism 13 or 130 of the above Embodiment 4 or 5, the positioning member 17 or 170 makes tapered engagement with a distal end portion of the lever 4 or a rear end portion of the threaded tube portion 3*b* of the head portion 2. Instead of the above tapered engagement, in the coupling mechanism 230 of the present embodiment, the lever 4 and the head portion 2 are coupled together with a double nut structure wherein a rear end face of the positioning member 270 is made abut against and tightened to a distal end face of the lever 4.

In FIG. 11, similarly to the positioning member 17 of FIG. 8, the positioning member 270 is formed with a hexagonal hole 17*c* and a threaded portion 17*b* on the outer circumferential surface thereof, while its rear end face is formed as a flat surface extending along the Y-axis direction.

The first female threaded portion 15*d* screwed to the threaded tube portion 15*a* formed at the distal end of the lever 4 and the second female threaded portion 15*e* screwed to the threaded portion 17*b* of the positioning member 270 are formed as a common female threaded portion on the inner circumferential surface of the threaded tube portion 3*b*.

The distal end of the threaded tube portion 15*a* of the lever 4 has a constant outside diameter up to the distal end, with a threaded portion screwed into the first female threaded portion 15*d* being formed on the outer circumferential surface thereof. The distal end face 15*f* of the threaded tube 15*d* is formed as a flat surface extending along the Y-axis.

With the coupling mechanism 230 of the present embodiment, similarly to Embodiment 4, the positioning member 270 is first screwed into the second female threaded portion 15*e*. Then, the lever 4 is turned and screwed in, to cause the threaded tube portion 15*a* of the lever 4 to screw into the first female threaded portion 15*d* of the threaded tube portion 3*b* of the head 2. The lever 4 is screwed in until the rear end face 17*d* of the positioning member 270 contacts the distal end face of the threaded tube portion 15*a*, and turned around the X-axis direction to a predetermined position relative to the head portion 2. In this state, the positioning member 270 is turned using a hexagonal wrench similarly to Embodiment 4 to advance it along the thread to the rear end side, so that the rear end face of the positioning member 270 is firmly pressed against the distal end face of the threaded tube 15*d*, whereby the positioning member 270 acts as a lock nut for the threaded tube 15*d*. The lever 4 is thus coupled to the head portion 2.

The coupling mechanism of the present embodiment may be applied to the configuration of Embodiment 5 shown in FIG. 10.

While the present invention has been described in detail by way of particular embodiments thereof, it will be apparent to those skilled in the art that various changes and modifications could be made without departing from the spirit and scope of the present invention.

As described above in detail, according to the present invention, in a torque wrench with a torque limiter having a configuration in which the principle of leverage is used to cause a cam follower in the form of a solid columnar roller to make pressure contact with a cam that transmits a tightening force to a fastener such as a bolt or nut when tightening the same with a spring pressure of a torque setting spring, a technique that realizes more stable operation and enables highly precise tightening can be provided.

[Description of Reference Numerals]

1, 100 Torque wrench
2 Head portion
3*a* case portion 3*b* threaded tube portion 3*c* lid
3*d* upper wall portion 3*e*, 3*f*, 3*g*, 3*h* hollow part
4 Lever
5 shaft hole
6 Grip
7 Cam part
7*a* torque transmitting cam surface 7*b* torque non-transmitting cam surface
8 Cam shaft
8*a* shaft hole 8*b* upper circumferential groove 8*c* lower circumferential groove 8*d* ratchet teeth
9*a*, 9*b*, 9*c* Steel ball
10 Ratchet claw
11 Transmission shaft
11*a* main shaft 11*b* square shaft
12 Roller support lever member
12*a* bearing recess 12*b* pivot recess
13, 130, 230 Coupling mechanism
14 Roller member
15*a* Threaded tube portion 15*b* spreading portion 15*c* tapered female engaging portion
15*d* First female threaded portion 15*e* second female threaded portion
16 Support shaft
17, 170, 270 Positioning member
17*a* pressing portion 17*b* threaded portion 17*c* hexagonal hole
18 Spring force transmitting rod
20 Rod seat
20*a* pivot recess
21 Adjusting nut
22 Torque setting spring
24 Torque adjusting screw rod
25 Steel ball
26 Bearing recess
30 Microswitch
300 Tightened portion

The invention claimed is:

1. A torque wrench comprising:

a head portion having a cylindrical cam shaft rotatably disposed with a plurality of cam parts formed on an outer circumference thereof, the cam parts each having a torque transmitting cam surface and a torque non-transmitting cam surface, and a torque transmission shaft coaxially disposed inside the cam shaft for tightening an object to be tightened via a ratchet mechanism;

a tubular lever fixed to a rear end portion of the head portion and accommodating therein a spring force transmitting rod biased by a torque setting spring;

a roller member engaged with the cam part; and a roller support lever member rotatably mounted in the head portion via a support shaft for rotatably supporting the roller member and for applying the spring force via the spring force transmitting rod to the roller member so as to cause a tightening reaction force to be applied to the roller member, wherein the roller support lever member is configured such that a distance from the support shaft to a point of application of force of the spring force transmitting rod is longer than a distance from the support shaft to the roller member.

2. The torque wrench according to claim 1, wherein the roller member is solid and columnar.

3. The torque wrench according to claim 1, wherein the cam part is configured such that, in a position where the roller member is stationary and in engagement therewith, a vector along a normal direction of a reaction force applied to the roller member is displaced by an angle θ in a tightening direction relative to a base line connecting an axial center of the roller member and an axial center of the support shaft.

4. The torque wrench according to claim 1, wherein the cam part is configured such that, in a position where the roller member is stationary and in engagement therewith, a vector along a normal direction of a reaction force applied to the roller member is displaced by an angle θ larger than 0° and smaller than 45° in a tightening direction relative to a base line connecting an axial center of the roller member and an axial center of the support shaft.

5. The torque wrench according to claim 1, wherein the cam shaft disposed inside the head portion is formed with circumferential grooves on an outer circumference at both axial ends thereof, with a plurality of steel balls being disposed between each of the circumferential grooves and an inner circumferential wall surface of the head portion opposite and spaced apart therefrom to form radial bearings, and wherein the steel balls are made abut on an inner wall surface of the head portion that is axially above an axial outer end of the cam shaft so as to form a gap between the axial outer end of the cam shaft and the axial inner wall surface of the head portion.

6. The torque wrench according to claim 1, further comprising a rolling bearing including a plurality of rolling elements disposed between an inner race and an outer race, the rolling bearing being disposed at both axial ends of the cam shaft between an inner circumferential surface of the head portion and the cam shaft disposed inside the head portion.

7. The torque wrench according to claim 1, wherein a steel ball forming a thrust bearing is disposed between one end face of the transmission shaft opposite from a side engaged with the object to be tightened and an inner wall surface of the head portion facing the one end face.

8. The torque wrench according to claim 1, wherein steel balls forming thrust bearings are disposed between both axial ends of the support shaft of the roller support lever member and inner wall surfaces of the head portion, respectively.

9. The torque wrench according to claim 1, wherein the spring force transmitting rod has its both ends formed in a spherical shape, with engaging recesses that engage with the rod such as to allow pivotal movement of the rod being formed in the roller support lever member and in an abutting member on the side of the torque setting spring, respectively.

10. The torque wrench according to claim 1, further comprising a sensor for detecting a change in inclination of the spring force transmitting rod relative to an axial direction of the lever upon rotation of the roller support lever member, as the roller member moves along a torque transmitting cam surface of the cam part toward a cam top by a tightening reaction force.

11. The torque wrench according to claim 1, further comprising a coupling mechanism for coupling a distal end portion of the lever to a rear portion of the head portion by screw coupling, wherein the coupling mechanism includes threaded portions respectively formed to threaded tube portions respectively formed at the rear end portion of the head portion and at the distal end portion of the lever to be internally or externally screwed to each other, and a cylindrical positioning member abutting on and pressing a distal end portion of one of the threaded tube portions on the internal or external side against the other one of the threaded tube portions, and wherein the positioning member is screwed to a threaded portion of the other threaded tube portion and abuts and makes pressure contact with a distal end face of the one threaded tube portion so as to fix the head portion and the lever at an arbitrary position in a circumferential direction around an axial center of the lever.

12. The torque wrench according to claim 1, further comprising a coupling mechanism for coupling a distal end portion of the lever to a rear portion of the head portion by screw coupling, wherein the coupling mechanism includes threaded portions respectively formed to threaded tube portions respectively formed at the rear end portion of the head portion and at the distal end portion of the lever to be internally or externally screwed to each other, and a cylindrical positioning member abutting on and pressing a distal end portion of one of the threaded tube portions on the internal or external side against the other one of the threaded tube portions, and wherein the positioning member is screwed to a threaded portion of the other threaded tube portion and makes tapered engagement with a distal end portion of the one threaded tube portion so as to fix the head portion and the lever at an arbitrary position in a circumferential direction around an axial center of the lever.

13. The torque wrench according to claim 12, wherein the positioning member of the coupling mechanism is screwed to an inner circumferential threaded portion of the other threaded tube portion into which the one threaded tube portion is internally screwed, so that the positioning member makes tapered engagement with an inner circumferential surface of the distal end portion of the one threaded tube portion to spread and press the distal end portion of the one threaded tube portion against the inner circumferential surface of the one threaded tube portion, whereby the head portion and the lever are fixed to each other.

14. The torque wrench according to claim 12, wherein the positioning member of the coupling mechanism is screwed to an outer circumferential threaded portion of the other threaded tube portion onto which the one threaded tube portion is externally screwed, so that the positioning member makes tapered engagement with an outer circumferential surface of the distal end portion of the one threaded tube portion to tighten the distal end portion of the one threaded tube portion onto the outer circumferential surface of the other threaded tube portion, whereby the head portion and the lever are fixed to each other.

15. The torque wrench according to claim 1, comprising a sensor that detects an inclining movement of the spring force transmitting rod caused by a rotation of the roller support lever member as the roller member engages with and traces the cam part.

16. The torque wrench according to claim 15, wherein the coupling mechanism arbitrary determines positions of the sensor and the spring force transmitting rod in a circumferential direction around an axial center of the lever, whereby the head portion and the lever are positioned and fixed.

17. The torque wrench according to claim 16, wherein the coupling mechanism positions and fixes the head portion and the lever at a position where the sensor is activated when the rod reaches a maximum inclined position.

* * * * *